US005158433A

United States Patent [19]

Cleary

[11] Patent Number: 5,158,433

[45] Date of Patent: Oct. 27, 1992

[54] MARINE PROPELLER HAVING AN OUTWARDLY FLARED HUB

[75] Inventor: Kevin T. Cleary, West Bend, Wis.

[73] Assignee: Brunswick Corporation, Skokie, Ill.

[21] Appl. No.: 643,280

[22] Filed: Jan. 21, 1991

[51] Int. Cl.[5] ..... B63H 1/28

[52] U.S. Cl. ..... 416/93 A; 416/241 R; 416/244 B; 415/200; 415/915; 29/889.6; 72/370

[58] Field of Search ..... 416/93 R, 93 A, 241 R, 416/244 B, 245 R, 245 A; 415/200, 915; 29/889.6, 889.61; 72/352, 370

[56] References Cited

U.S. PATENT DOCUMENTS

| | | | |
|---|---|---|---|
| 4,049,474 | 9/1977 | Zakharov et al. | 148/32 |
| 4,793,773 | 12/1988 | Kinouchi et al. | 416/93 A |
| 4,802,872 | 2/1989 | Stanton | 416/93 A |
| 4,834,683 | 5/1989 | Govan | 416/93 A |

FOREIGN PATENT DOCUMENTS

| | | | |
|---|---|---|---|
| 1442123 | 7/1976 | United Kingdom | 72/352 |

*Primary Examiner*—Edward K. Look
*Assistant Examiner*—Christopher M. Verdier
*Attorney, Agent, or Firm*—Andrus, Sceales, Starke & Sawall

[57] ABSTRACT

A marine propeller including an inner hub to receive a driving connection to the engine and an outer hub is spaced outwardly from the inner hub to provide a passage therebetween for the discharge of exhaust gas from the engine. A plurality of blades extend outwardly from the outer hub. A propeller is die cast from an aluminum alloy and as cast the outer surface hub is cylindrical in configuration. After casting the trailing end of the outer hub is swaged outwardly by a tapered tool to provide an outwardly flared trailing end, which assists gas flow and enhances performance of the engine.

11 Claims, 2 Drawing Sheets

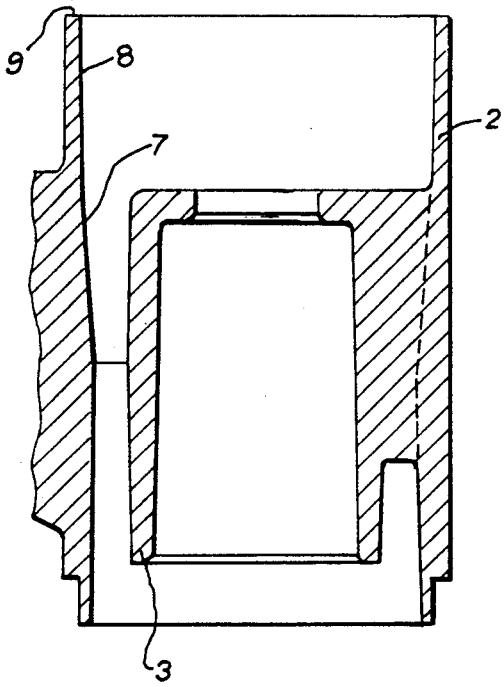
FIG. 3
FIG. 4
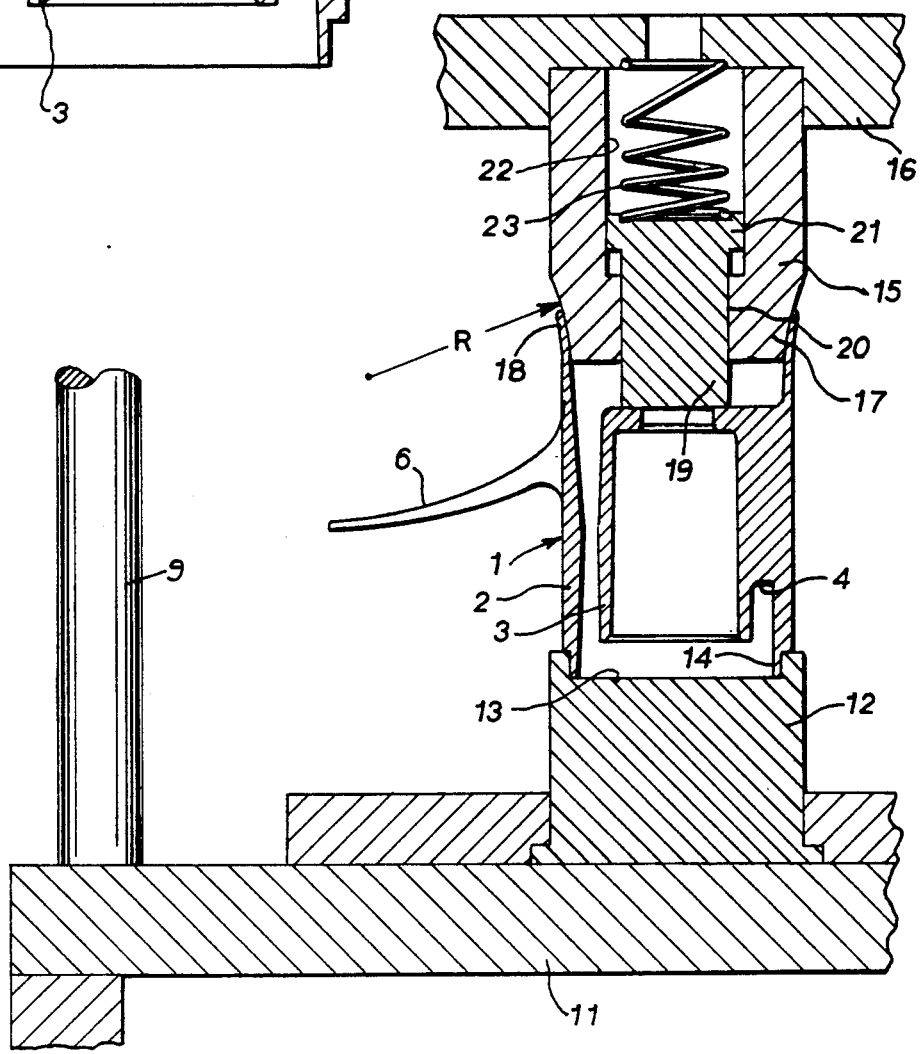

MARINE PROPELLER HAVING AN OUTWARDLY FLARED HUB

BACKGROUND OF THE INVENTION

Certain types of marine propellers provide for the discharge of exhaust gases through the propeller, and beneath the water level at a location behind the boat. Propellers of this type include an inner hub, which is connected to the drive shaft of the engine, and an outer hub is spaced radially outward of the inner hub and is connected thereto by a series of radial legs. The space between the hubs defines an exhaust gas passage through which the gas is discharged beneath the water level. A plurality of blades are formed integrally with the outer hub.

To improve the engine and boat performance it has been proposed to attach a diffuser ring to the trailing end of the outer hub. The diffuser ring is flared outwardly and assists in exhaust gas flow and provides a pressure barrier that helps prevent exhaust gases from feeding back into the propeller blades. The outwardly flared diffuser ring thus provides an increase in engine performance.

In the past, the diffuser ring was a separate component, normally stamped from aluminum and attached to the trailing end of the outer hub of the propeller. To provide the attachment, the outer diameter of the outer hub was machined and the stamped diffuser ring was swaged onto the machined surface. This procedure in forming and installing the diffuser ring was costly and time consuming.

SUMMARY OF THE INVENTION

The invention is directed to an aluminum alloy marine propeller having an exhaust flow passage and having an integral, outwardly flared trailing end. More specifically, the propeller includes an inner hub having a drive connection for the engine drive shaft and an outer hub which is spaced radially outward of the inner hub and is connected to the inner hub by a group of radial legs. A plurality of blades are formed integrally with the outer hub and the trailing end of the outer hub is curved outwardly to provide a flared end.

The propeller is die cast from an aluminum alloy containing by weight 0.5% to 1.0% silicon, 3.0% to 4.5% of magnesium, 0.4% to 0.6% of manganese, and the balance aluminum.

As cast, the outer hub of the aluminum alloy propeller is cylindrical in configuration, and after casting, the trailing end of the outer hub is swaged outwardly by a tapered tool to provide an outwardly flared trailing end for the outer hub.

The trailing end portion of the outer hub is cast with a contour which will enable the trailing end to be flared outwardly. In this regard, a section of the internal wall of the outer hub extending rearwardly from the radial legs is tapered outwardly at an angle of about 3° and this inner wall section merges into a second inner wall section extending to the trailing end and having a lesser outward taper of about 1°. The annular outer trailing edge or extremity of the outer hub has a thickness of about 0.120 inches. This configuration aids in filling out the trailing end portion of the hub during casting and prevents cracking during the flaring operation.

Through the invention, the flared end of the outer hub is formed integrally with the propeller, thus, eliminating the need of a separate diffuser ring, as has been used in the past. By eliminating the diffuser ring, the machining and swaging operations as previously employed have been eliminated which substantially reduces the overall cost of the die cast propeller.

Other objects and advantages will appear in the course of the following description.

BRIEF DESCRIPTION OF THE DRAWINGS

The drawings illustrate the best mode presently contemplated of carrying out the invention.

In the drawings:

FIG. 3 is a fragmentary longitudinal section of the propeller before flaring; and FIG. 4 is a longitudinal section of the propeller mounted on the flaring fixture.

DESCRIPTION OF THE ILLUSTRATED EMBODIMENT

Figure 1:
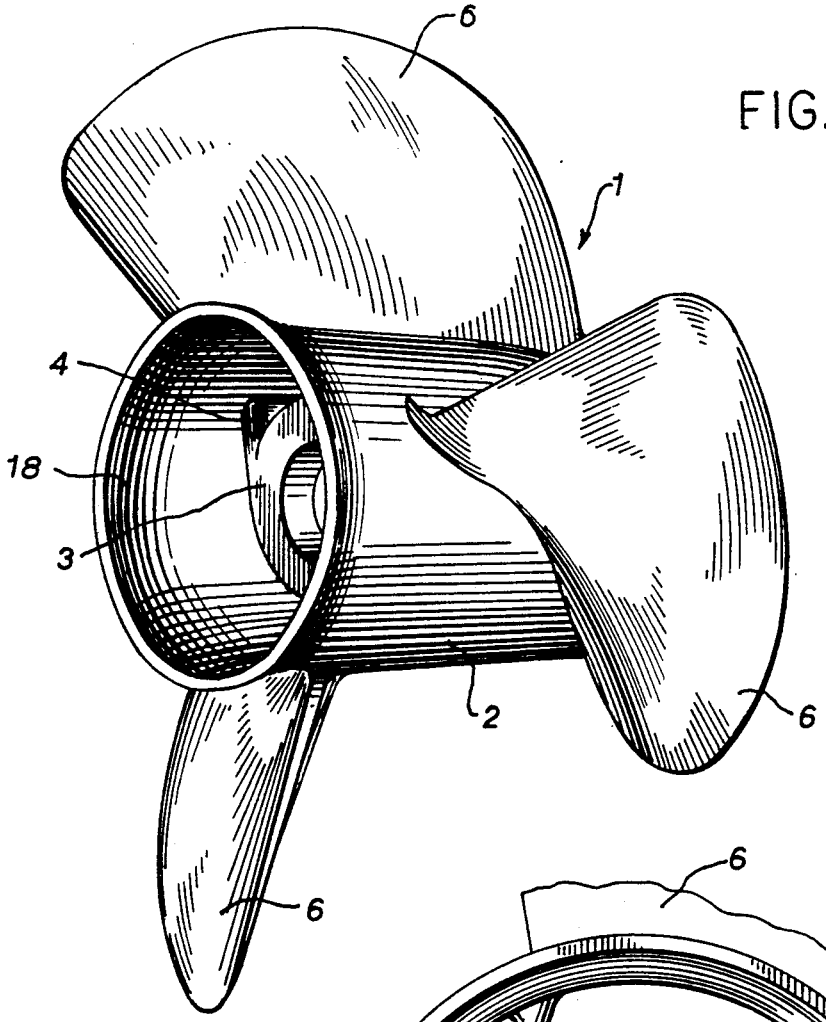
FIG. 1 is a perspective view of the propeller of the invention having an outwardly flared trailing end.

FIG. 1 illustrates a metal die cast marine propeller made in accordance with the invention. Propeller 1 includes an outer hub 2, which is spaced radially outward of an inner hub 3 and connected to the inner hub via a plurality of circumferentially spaced radial legs 4. The space between the inner hub 3 and outer hub 2 defines a passage 5 for the flow of exhaust gas from the engine. The exhaust gas is discharged from passage 5 beneath the level of the water at a distance behind the boat to thereby reduce the exhaust noise. Inner hub 3 receives a splined bushing, not shown, which provides a connection to the engine drive shaft.

A plurality of blades 6 are cast integrally with the outer housing 2.

The propeller is cast from an aluminum alloy having the following composition in weight percent:

| | |
|---|---|
| Silicon | 0.5–1.0 |
| Magnesium | 3.0–4.5 |
| Manganese | 0.40–0.60 |
| Iron | 0.9 max. |
| Copper | 0.15 max. |
| Zinc | 0.10 max. |
| Chromium | 0.05 max. |
| Nickel | 0.50 max. |
| Titanium | 0.05 max. |
| Tin | 0.05 max. |
| Aluminum | Balance |

A specific alloy composition falling within the above-mentioned range is as follows:

| | |
|---|---|
| Silicon | 0.71 |
| Magnesium | 3.24 |
| Manganese | 0.48 |
| Iron | 0.65 |
| Copper | 0.07 |
| Zinc | 0.04 |
| Chromium | 0.01 |
| Nickel | 0.01 |
| Titanium | 0.02 |
| Tin | 0.003 |
| Aluminum | Balance |

As cast, the outer surface of outer hub 2 is cylindrical, as illustrated in FIG. 3. Outer hub 2 includes an internal wall section 7 which extends axially outward from approximately the longitudinal center of the hub and tapers outwardly at an angle of about 3° with respect to the axis of the hub. As shown in FIG. 3, wall 7 merges into internal wall section 8, which extends from wall section 7 to the outer edge or extremity 9 of the outer hub. Wall 8 is disposed at a lesser degree of taper, approximately 1° with respect to the axis of the hub. The as cast configuration of the trailing end portion of outer hub 2 is important in enabling the end portion to properly fill out during casting, but also to permit the end portion to be flared outwardly without cracking.

FIG. 4 illustrates the mechanism utilized to flare the trailing end of the outer hub 2 outwardly. The flaring mechanism includes a base plate 11 and a generally cylindrical post or column 12 extends upwardly from the base plate. The upper end of the post 12 is formed with a cylindrical recess 13 and the flange 14 on the leading end of outer hub 2 is received within the recess and engages the bottom of the recess.

A tapered flaring tool 15 is mounted on a vertically movable platen 16 which can be moved vertically toward and away from base plate 11 by a suitable mechanical or hydraulic mechanism. Suitable guide rods 9 extend upwardly from the base plate 11 and are slidable received within bushings in platen 16, as the platen is raised and lowered.

Figure 2:
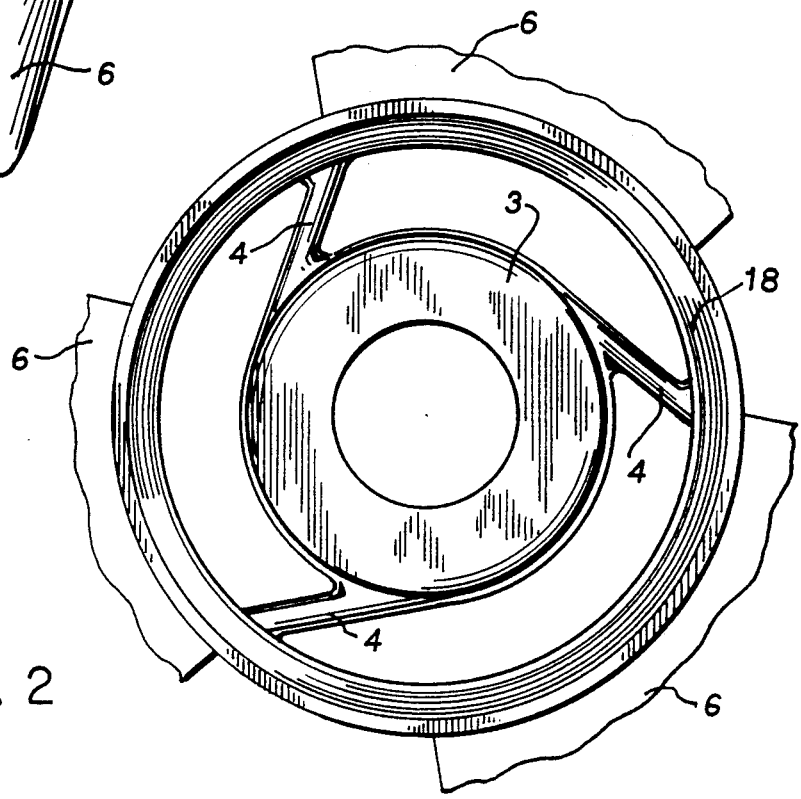
FIG. 2 is a fragmentary end view of the propeller.

Tool 15 is provided with an inwardly tapered end 17 which is generally concave, as shown in FIG. 4, and has a radius R of approximately 3 inches. As the tapered end 17 is moved downwardly into the trailing end of the outer hub 2, the hub end will be flared outwardly on a curvature corresponding to the radius R as shown by 18 in FIGS. 1, 2 and 4.

A stripper 19 is mounted for sliding movement in an opening 20 in the end of tool 15 and the upper end of the stripper is provided with a collar 21 which is slidable within the recess 22 in the upper end of tool 15. A coil spring 23 is interposed between platen 16 and the collar 21 and urges the stripper 18 downwardly. After the flaring operation, when the platen 16 is elevated, stripper 19 will strip the propeller from the tool 15.

Propeller 1 is die cast from the aluminum alloy using conventional die casting techniques. After removal from the die, the cast propeller is quenched, preferably in water, and the flash is then trimmed from the casting, through use of a trim press, while an air sander is employed to remove flash on the inner surface of the hub. Following this, a band saw is employed to remove the gate and riser and the cast propeller is then mounted on the post 12 in the flaring mechanism. Through operation of the flaring tool 15, the trailing end of the outer hub 2 is flared outwardly as shown in FIG. 4.

The flaring operation can be carried out with the cast propeller either being at room temperature or at an elevated temperature up to 500° F. In either case the flaring can be accomplished without cracking or otherwise distorting the trailing end of the hub.

The specific aluminum alloy, as set forth above, in conjunction with the configuration of the as-cast outer hub, enables the trailing end of the hub to be filled out during casting and permits the trailing end to be flared without cracking. The result is a one-piece integral die cast propeller having an outwardly flared trailing end. The invention eliminates the need for a separate diffuser ring, as used in the past, and thereby eliminates the machining and swaging operations that were required when attaching a separate diffuser ring to the trailing end of the outer hub.

The flared end of the outer hub provides improved engine and boat performance by assisting the flow of exhaust gas through the propeller and providing a pressure barrier that aids in preventing exhaust gases from feeding back into the propeller blades.

Various modes of carrying out the invention are contemplated as being within the scope of the following claims particularly pointing out and distinctly claiming the subject matter which is regarded as the invention.

We claim:

1. A cast marine propeller, comprising an inner hub, an outer hub spaced radially outward of said inner hub to provide an exhaust passage therebetween, a plurality of blades extending outwardly from said outer hub, said propeller being composed of an aluminum alloy comprising by weight 0.5% to 1.0% silicon, 3.0% to 4.5% magnesium, up to 0.9% iron, 0.4% to 0.6% manganese and the balance aluminum, said outer hub including an integral trailing end that is flared outwardly, said outer hub including a first internal wall section extending longitudinally inward from said trailing end and further including a second internal wall section extending longitudinally inward from said first wall section, said second wall section being tapered outwardly at a first angle to the axis of said outer hub and said first wall section being tapered outwardly with respect to said axis at a second angle less than the first angle.

2. The propeller of claim 1, wherein said first angle is about 3° and said second angle is about 1°.

3. The propeller of claim 1, wherein the outer extremity of said trailing end of said outer hub has a thickness of about 0.120 inches.

4. A cast marine propeller, comprising an inner hub, an outer hub spaced radially outward of said inner hub, a plurality of blades extending outwardly of said outer hub, a plurality of circumferentially spaced ribs connecting said outer hub and said inner hub with the spaces between said ribs comprising passages for the flow of gas, said propeller consisting essentially of in weight percent:

| | |
|---|---|
| Silicon | 0.5–1.0 |
| Magnesium | 3.0–4.5 |
| Manganese | 0.40–0.60 |
| Iron | 0.9 max. |
| Copper | 0.15 max. |
| Zinc | 0.10 max. |
| Chromium | 0.05 max. |
| Nickel | 0.50 max. |
| Titanium | 0.05 max. |
| Tin | 0.05 max. |
| Aluminum | Balance. |

said outer hub having an integral outwardly flared trailing end.

5. An as-cast marine propeller, comprising an inner hub, an outer hub spaced radially outward of said inner hub to provide an exhaust passage therebetween, a plurality of blades extending outwardly from said outer hub, said propeller being composed of an aluminum alloy comprising by weight 0.5% to 1.0% silicon, 3.0% to 4.5% magnesium, up to 0.9% iron, 0.4% to 0.6% manganese, and the balance aluminum, said outer hub having a generally cylindrical outer wall and said outer hub having a first internal wall section extending longitudinally inward from a trailing end of said outer hub and further including a second internal wall section extending longitudinally inward from said first wall section, said second wall section being tapered outwardly at a first angle to the axis of said outer hub and said first wall section being tapered outwardly with respect to said axis at a second angle less than the first angle.

6. A method of producing a cast marine propeller having an outwardly flared hub, comprising the steps of casting a propeller from an aluminum alloy comprising by weight 0.5% to 1.0% silicon, 3.0% to 4.5% magnesium, up to 0.9% iron, 0.4% to 0.6% manganese and the balance aluminum, said propeller having an inner hub and an outer hub spaced outwardly of the inner hub to provide a passage for the flow of exhaust gas, said propeller having a plurality of blades extending outwardly from said outer hub, said hubs each having a leading end and a trailing end, and flaring the trailing end of the outer hub outwardly to provide a generally curved outwardly flared trailing end for said outer hub, the step of casting the propeller comprising forming the outer hub with a first internal wall section extending longitudinally inward from the trailing end and a second internal wall section extending longitudinally inward from said first wall section, said second wall section being tapered outwardly at a first angle with respect to the axis of said outer hub and said first wall section being tapered outwardly at a second angle smaller than said first angle with respect to said axis.

7. The method of claim 6, wherein said first angle is about 3° and said second angle is about 1°.

8. A method of producing a cast marine propeller having an outwardly flared hub, comprising the steps of forming a molten aluminum alloy consisting essentially of in weight percent:

| | |
|---|---|
| Silicon | 0.5–1.0 |
| Magnesium | 3.0–4.5 |
| Manganese | 0.40–0.60 |
| Iron | 0.9 max. |
| Copper | 0.15 max. |
| Zinc | 0.10 max. |
| Chromium | 0.05 max. |
| Nickel | 0.50 max. |
| Titanium | 0.05 max. |
| Tin | 0.05 max. |
| Aluminum | Balance. |

casting said molten alloy to form a propeller having an inner hub and an outer hub spaced outwardly of the inner hub to provide a passage for the flow of exhaust gas and the propeller having a plurality of blades extending outwardly from said outer hub, and flaring a trailing end of the outer hub outwardly to provide a generally curved outwardly flared end.

9. The method of claim 8, wherein the step of flaring the trailing end comprises the steps of introducing a tapered end of a tool into said trailing end to deform said trailing end outwardly and provide said outwardly flared end.

10. The method of claim 9, wherein said tapered end of said tool is generally concave.

11. The method of claim 10, wherein the concave tapered end of said tool has a radius of about 3 inches.

* * * * *